US005171462A

United States Patent [19]

DeRosa et al.

[11] Patent Number: 5,171,462

[45] Date of Patent: Dec. 15, 1992

[54] MIXTURES OF POLYOXYALKYLENE ESTER AND AMINOPOLYAZOLES AS OXIDATION AND CORROSION RESISTANT LUBRICANT ADDITIVES

[75] Inventors: Thomas F. DeRosa, Passaic, N.J.; Rodney L. Sung, Fishkill, N.Y.; Benjamin J. Kaufman, Hopewell Junction, N.Y.; Ronald L. O'Rourke, Hyde Park, N.Y.

[73] Assignee: Texaco Inc., White Plains, N.Y.

[21] Appl. No.: 812,309

[22] Filed: Dec. 23, 1991

[51] Int. Cl.[5] ..... C10M 145/38; C10M 133/38

[52] U.S. Cl. ..... 252/47; 252/50; 252/52 A; 252/56 R; 252/390; 252/396; 252/401; 252/407; 560/187; 560/189

[58] Field of Search ..... 252/50, 52 A, 56 R, 252/47; 560/187, 189

[56] References Cited

U.S. PATENT DOCUMENTS

| | | | |
|---|---|---|---|
| 3,413,227 | 11/1968 | Howard et al. | 252/50 |
| 3,663,436 | 5/1972 | Carswell | 252/50 |
| 3,791,971 | 2/1974 | Lowe | 252/52 A |
| 3,809,652 | 5/1974 | Brennan | 252/56 R |
| 4,125,382 | 11/1978 | O'Brien et al. | 44/387 |
| 4,359,478 | 11/1982 | Schmolka | 560/189 |
| 4,464,276 | 8/1984 | Sung et al. | 252/42.7 |
| 4,758,363 | 3/1988 | Sung et al. | 252/51.5 |
| 4,808,335 | 3/1989 | Sung et al. | 252/47.5 |

FOREIGN PATENT DOCUMENTS

| | | |
|---|---|---|
| 444770A1 | 1/1991 | European Pat. Off. . |

*Primary Examiner*—Ellen McAvoy

*Attorney, Agent, or Firm*—Robert A. Kulason; James J. O'Loughlin; Henry H. Gibson

[57] ABSTRACT

Mixtures of block alkoxy co- or terpolymer hydrocarboxylates and aminopolyazole increase the oxidation and corrosion resistance of lubricants, particularly diesel engine oil.

11 Claims, No Drawings

MIXTURES OF POLYOXYALKYLENE ESTER AND AMINOPOLYAZOLES AS OXIDATION AND CORROSION RESISTANT LUBRICANT ADDITIVES

BACKGROUND OF THE INVENTION

1. Field of the Invention

This invention concerns lubricant additives and oil compositions containing and made with such additives. More particularly, this invention concerns mixtures of mono- or diesters of polyoxyalkylene diols with aminopolyazole which give increased oxidation and corrosion resistance to lubricants, like diesel engine oil.

2. Description of Related Information

Lubricants, while used primarily for lubrication, frequently need other properties, such as oxidation and corrosion resistance, to be used effectively. For example, lubricants used in the crankcases of large diesel engines, such as marine and railway diesel engines, are often subjected to operating conditions requiring special considerations. In particular, poor grade fuels, such as marine residual fuel, can be mixed with regular diesel fuel, such as D-2, for fuel cost savings. However, engine performance problems, such as increased corrosion and poor oxidative stability often arise. Additionally, new and more fuel efficient railway diesel engines place greater demands on the oxidation resistance of lubricants. Since oxidized lubricants cause increased engine corrosion, lubricants used for such newer engines are routinely changed more frequently to prevent such corrosive attack to avoid catastrophic engine failure.

Various additives have been used to improve the anti-oxidancy and corrosion resistance of lubricants. For example, calcium sulfurized alkyl phenolates have been effective. These compounds are typically made by processes including expensive recovery procedures and hazardous byproducts difficult to dispose of in an environmentally sound way. Alternatively, calcium sulfurized phenolates, made by a process using lime as the calcium source to avoid such processing problems, fail to provide a high level of oxidation and corrosion resistance.

Other oxidation and corrosion resistant additives have also been developed. For example, U.S. Pat. No. 4,464,276 (Sung et al.) discloses polyoxyalkylene polyamine triazole complexes as additives for lubricants having improved oxidative stability and corrosion control. U.S. Pat. No. 4,758,363 (Sung et al.) discloses the reaction product of esters of hydroxybenzoic acid and polyoxyalkylene polyol reacted with equimolar amounts of aldehyde or ketone and substituted or unsubstituted heterocyclic azole for improved oxidation and corrosion resistance of lubricating oils for diesel engines. U.S. Pat. No. 4,808,335 (Sung et al.) discloses reaction products of N-acyl sarcosine reacted with substituted or unsubstituted heterocyclic azole for improving oxidation and corrosion resistance of diesel engine lubricating oils.

SUMMARY OF THE INVENTION

This invention concerns lubricant additives, compositons and processes. The additive comprises a mixture of:

(1) polyoxyalkylene ester and (2) aminopolyazole. The polyoxyalkylene ester can have a structure:

$$RC\overset{O}{\overset{\|}{O}}(\overset{CH_2CH_3}{\overset{|}{C}}HCH_2O)_a(\overset{CH_3}{\overset{|}{C}}HCH_2O)_b(CH_2CH_2O)_c(\overset{CH_3}{\overset{|}{C}}HCH_2O)_d(\overset{CH_2CH_3}{\overset{|}{C}}HCH_2O)_e(-\overset{O}{\overset{\|}{C}}R')_n(-H)_{1-n}$$

In the structure: R and R' are independently unsaturated hydrocarbyl having at least about 10 carbon atoms; the sum of a+e is an average of from 0 to about 12; the sum of b+d is an average of from about 5 to about 150; c is an average of from about 5 to about 150; and n is 0 or 1. The lubricant composition comprises lubricant and an effective amount of the additive. Processes for increasing the oxidation and corrosion resistance of lubricant are characterized by adding to the lubricant an effective amount of the additive.

DETAILED DESCRIPTION OF THE INVENTION

The lubricant additives of this invention comprise, and in an embodiment consist essentially of, mixtures of polyoxyalkylene ester and aminopolyazole.

The polyoxyalkylene ester is a block co- or terpolymer containing oxyethylene and oxypropylene, and optionally oxybutylene, repeating units which is capped at one or both ends with unsaturated hydrocarbyl ester groups. The polyoxyalkylene ester can generally have a structure as shown in Formula 1.

$$RC\overset{O}{\overset{\|}{O}}(\overset{CH_2CH_3}{\overset{|}{C}}HCH_2O)_a(\overset{CH_3}{\overset{|}{C}}HCH_2O)_b(CH_2CH_2O)_c(\overset{CH_3}{\overset{|}{C}}HCH_2O)_d(\overset{CH_2CH_3}{\overset{|}{C}}HCH_2O)_e(-\overset{O}{\overset{\|}{C}}R')_n(-H)_{1-n}$$

Formula 1. Polyoxyalkylene Ester

In Formula 1, R and R' are independently unsaturated, monovalent hydrocarbyl groups. The term "hydrocarbyl" is used in this disclosure to describe any group having hydrogen and carbon atoms. The hydrocarbyl is unsaturated, having one or more carbon-carbon double or triple bonds. The hydrocarbyl may be: alkenyl, such as $C_nH_{2n}$; alkynyl, such as $C_nH_{2n-2}$; or aromatic such as aryl, aralkyl or alkaryl. The hydrocarbyl may be linear, branched or cyclic. One or more hetero atoms, such as halogen, oxygen, nitrogen, sulfur, phosphorus or other elements may be present. The unsaturated hydrocarbyl generally has at least about 10, preferably from about 12 to about 25, and most preferably from about 14 to about 20, carbon atoms. Typical R and R' groups include, among others, one or mixtures of the following: cis-9-octadecenoyl, commonly called oleyl; cis-9,12-octadecadienoyl, commonly called linoleyl; other monoor polyunsaturated fatty acids, including mixtures with saturated fatty acids like tallow oil made of saturated and unsaturated fatty acids having from 14 to 18 carbon atoms; and the like. Preferred unsaturated hydrocarbyl groups are alkenyl, such as oleyl, linoleyl and mixtures or admixtures derived from tallow oil.

The polyether portion of the polyoxyalkylene ester is a block co- or terpolymer having ethoxy and propoxy, and optionally butoxy, repeating units. The particular repeating structures given in Formula 1 are only illustrative. Corresponding propoxy or butoxy isomers, such as:

$$-CH_2\overset{\overset{\displaystyle CH_3}{|}}{C}HO- \quad \text{and} \quad -CH_2\overset{\overset{\displaystyle H_3CCH_2}{|}}{C}HO-.$$

are equally suitable, reflecting the addition site of the monomer. The polymer is a composition of a mixture of polymer molecules having varying chain lengths of oxyalkylene units and which, as a whole, has an average number of each type of oxyalkylene repeating units and molecular weight. The polyether may optionally contain additional oxyalkylene, such as pentoxy or higher alkoxy groups, or other repeating units to the extent they do not significantly interfere with the properties of the ester used in this invention. The average number of repeating units within each block polyether segment, given by a, b, c, d and e in Formula 1, can vary depending on the desired properties, such as hydrophilic/lipophilic balance, commonly called HLB, for the resulting polymer composition. The average number of butoxy repeating units per molecule, given by the sum of a+e, may be 0, is typically from about 1 to about 12, preferably from about 2 to about 8, and most preferably from about 2.5 to about 5. The average number of propoxy repeating units per molecule, given by the sum of b+d, is typically from about 5 to about 150, preferably from about 10 to about 50, and most preferably from about 20 to about 50. The average number of ethoxy repeating units per molecule, given by c, is typically from about 5 to about 150, preferably from about 10 to about 50, and most preferably from about 20 to about 50.

The variable n, which may be 0 or 1, in Formula 1 characterizes whether the ester is a monoester, when n is 0, or a diester, when n is 1. Diesters are preferred.

Typically, the polyoxyalkylene ester will have an average molecular weight of from about 500 to about 100,000 atomic mass units (amu), preferably from about 500 to about 10,000 amu, and most preferably from about 2,000 to about 5,000 amu.

Suitable polyoxyalkylene esters are disclosed in European Patent Application Publication No. A-0,444,770 (Sung et al.) which is incorporated by reference into this disclosure.

The polyoxyalkylene ester can be made by any, including known, esterification procedure, typically by reacting (butoxy/) propoxy/ethoxy block co- or ter-polymer diol, with unsaturated hydrocarbyl carboxylic acid, anhydride, acid halide or other suitable derivative. The polyoxyalkylene diol and unsaturated hydrocarbyl carboxylic starting materials can be obtained from any suitable source. For example, block coor terpolymers of propoxy and ethoxy, with or without butoxy repeating units, are available from Texaco Chemical Company, Inc. Unsaturated hydrocarbyl carboxylic acids, like fatty acids, are widely available, such as from Witco Chemical Co., and Hercules, Inc. Any suitable, including known, esterification conditions, and catalysts like toluene sulfonic acid or other acidic or basic catalysts, and other materials can be used. The temperature typically ranges from about 10° C. to about 250° C., preferably from about 50° C. to about 200° C., and most preferably from about 80° C. to about 120° C. The esterification reaction may be conducted for any time sufficient to form the diester, and typically takes from about 1 to about 100 hours, preferably from about 2 to about 10 hours, and most preferably from about 2 to about 4, hours.

A typical ester synthesis involves dissolving the polyoxyalkylene diol and unsaturated hydrocarbyl carboxylic compound in solvent. The solution is heated to reflux and the reaction monitored to completion. Following the reaction, the ester product can, if desired, be purified and isolated using standard techniques.

The aminopolyazole is an unsaturated, heterocyclic compound having a 5-member ring with at least 3 ring nitrogen or other hetero atoms, at least 2 of which are nitrogen, and amino-substitution. Suitable aminopolyazoles include compounds having structures shown in Formula 2.

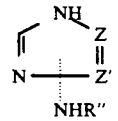

Formula 2. Aminopolyazoles

In Formula 2, the R'' substituent in the amino group is either hydrogen or alkyl, and preferably hydrogen. Z and Z' are independently nitrogen or another hetero atom, like sulfur, except that one Z or Z' may be carbon. The amino substituent, NHR'', may be located at: the 2-, 3- or 5- position for aminothiadiazoles, where one Z or Z' is sulfur and the other is carbon; the 2-, 4- or 5-position for aminotriazoles, where one Z or Z' is nitrogen and the other is carbon; or at the 4- or 5-position for aminotetrazoles, where both Z and Z'0 are nitrogen. The aminopolyazole may contain additional substituents, like hydrocarbyl, alkoxyl or any other suitable group, to the extent the substituent does not interfere with the aminopolyazole properties used in this invention. Typical aminopolyazoles include, among others, one or mixtures of the following: amino-1,2,4-(or -1,3,4-)triazoles like 3-aminotriazoles, 4-aminotriazoles and 5-aminotriazoles; aminotetrazoles like 5-amino-1,2,3,4-tetrazole; aminomercaptothiadiazoles such 5-amino-2-mercapto-1,3,4-thiadiazoles; aminobenzotriazoles such as 1-aminobenzo-1,2,4-triazole; and the like. Amino-1,2,4-triazoles are preferred. Suitable aminopolyazoles are available from, for example, Aldrich Chemical Company.

The relative amount of polyoxyalkylene ester to aminopolyazole may be any amount which makes an effective lubricant additive. Typically, the amount of polyoxyalkylene ester to aminopolyazole is from about 10:1 to about 5,000:1, preferably from about 100:1 to about 2,500:1, and most preferably from about 100:1 to about 200:1.

The lubricant composition can contain, if desired, any other materials useful in lubricants. Such other materials include, among others, one or more of the following: dispersants; detergents, like overbased sulfurized calcium alkylphenolate or those described in U.S. Pat. No. 4,083,699 (Chibnik); viscosity index improvers; oleaginous agents; antifoamants, like methyl silicon polymer in kerosene; pour depressors, like polymethacrylate; anti-wear agents, like zinc dialkyl dithiophosphate; demulsifiers, like dimethyl polysiloxane; other anti-oxidants, like alkylated diphenylamine; other corrosion inhibitors, like ethoxylated nonyl phenol; and other materials useful in lubricants. Preferred optional additives or additive packages include: ORONITE® OLOA-2939 Oil Additive Package from Chevron Chemical Company; TLA-388 Lubricant Additive from Texaco Chemical Co.; and the like. The amount of such materials may be any desired, including known, amounts which provide the desired properties.

The new additive may be used in any, including known, lubricant. Typical lubricants include, among others, one or mixtures of the following: hydrocarbon oils, such as those having naphthenic base, paraffinic base, mixed base mineral oils; oils derived from coal products; synthetic oils, such as alkylene polymers including polypropylene and polyisobutylene having molecular weights of between about 250 and 2500; and the like. The type of lubricant can vary depending upon the particular application or properties desired For example, marine diesel engine lubricants can contain hydrocarbon lubricating oil having a Total Base Number (TBN) of 3–8, typically 6, which may be made by blending paraffinic Solvent Neutral Oil (SNO)-20 having a Viscosity Index (VI) of about 92 and a viscosity of 47-53 centistokes (CSt.) at 40.C. and of 6.65–7.15 CSt. at 100° C., with a paraffinic SNO-50 having a VI of about 93 and a viscosity of 158–180 CSt. at 40° C. and of 15.3–16.4 CSt. at 100° C. Typical railway diesel engine lubricants can contain mixtures of paraffinic mineral oil having a viscosity of 5.5–10.0, such as 8.5, CSt. at 100° C., paraffinic mineral oil having a viscosity of 8.0–15.0, such as 14.5, CSt. at 100° C., and naphthenic pale oil having a viscosity of 8.0–15.0, such as 14.2, CSt. at 100° C. Preferred lubricants include N300 Pale Oil and N900 Pale Oil from Texaco Inc., and the like.

The amount of new additive in the lubricant composition is an effective amount, meaning any amount which increases the oxidation and corrosion resistance of the lubricant. Typically, the lubricant contains from about 0.1% to about 50%, preferably from about 0.5% to about 10%, and most preferably from about 1% to about 3% additive, based on the weight of the total composition containing lubricant, additive and any other materials present. The new additives are particularly useful in diesel engine oils, such as used in marine and railway diesel engines, by enhancing both anti-oxidancy and anti-corrosion properties of the lubricant.

The lubricant composition may be made by any, including known, procedure for making lubricant formulations. Typically, the new additive is added to the lubricant by blending the components together, producing a generally haze-free lubricant with increased oxidation and corrosion resistance.

The improved oxidation and corrosion inhibiting properties of the new additive may be shown by any one or more procedures for analyzing such properties. A typical procedure, called the Union Pacific Oxidation Test (UPOT), is used by railroads to judge the acceptability of lubricant. This procedure tests for corrosion by measuring weight loss and oxidative stability by measuring material viscosity increase, as well as other oil parameters, such as pH and base number (TBN) as a measure of alkaline retention. The UPOT test is conducted by bubbling 5 liters of oxygen per hour through 300 milliliters of test oil composition at about 140° C. A 1 inch by 3 inch by 0.06 inch steel-backed, copper-lead test specimen, cut from bearing stock, is immersed in the oil composition. The viscosity of the test oil is measured before and after a 144 hour test period. Greater differences between the initial and final viscosities indicates higher oxidation levels. The test specimen is weighed before and after the test and weight loss calculated. Greater weight loss shows greater corrosion.

The following examples present illustrative embodiments of this invention without intention to limited scope. All percentages given in the disclosure and claims are in weight percent, unless otherwise stated.

EXAMPLES Example 1 Polyoxyalkylene Ester Synthesis

This example shows a procedure for making the dioleyl ester of poly(oxybutylene-b-oxypropylene-b-oxyethylene-b-oxypropylene-b-oxybutylene) diol. The diol (250 g.), having a molecular weight of 3,441 amu and containing 5 mole percent oxybutylene, 45 mole percent oxypropylene, and 50 mole percent oxyethylene, is dissolved in 200 ml. anhydrous tetrahydrofuran (THF) along with 23.7 g., a 10% stoichiometric excess, of oleyl chloride dissolved in 100 ml. THF. The solution is heated to a reflux temperature of about 75.C. for about 2 hours. Sample aliquots are removed at 30 minute intervals to monitor the reaction using infrared analysis by measuring the disappearance of the free alcohol group, at 3,400 cm.$^{-1}$ to 3,250 cm.$^{-1}$ absorbance, and the appearance of the ester group, at 1,740 cm.$^{-1}$ to 1,731 cm.$^{-1}$. Once the reaction is complete, THF solvent is removed by vacuum stripping or atmospheric distillation of between 125° to 135° C. to give 268 g. of viscous golden fluid product.

Examples 2C-4 Lubricant Compositons and Analyses

In Control Example 2C, a lubricant composition is made by combining the components listed in Table I. In Control Example 3C, 2 weight percent of the polyoxyalkylene ester of Example 1 is added to the lubricant composition of Example 1C to make a composition as given in Table I. In Example 4, polyoxyalkylene ester of Example 1 and 3-amino-1,2,4-triazole, mixed at a weight ratio of 15:1, respectively, are added to the lubricant composition of Example 1C to make a composition, as given in Table I, having 2 weight percent additive mixture. Corresponding lubricant compositions with only aminopolyazole above 0.1% are not presented since aminopolyazoles are generally insoluble and sublime out of such a composition. The compositions of Examples 2C, 3C and 4 are tested following the previously described UPOT test procedure, with weight loss (in milligrams) and viscosity increase (at 100.F., in percent) results shown in Table I.

TABLE I

LUBRICANT COMPOSITION AND ANALYSES

| | Example No. | | |
|---|---|---|---|
| | 2C | 3C | 4 |
| Lubricant Compositions: (%) | | | |
| N900 Pale Oil | 70.55 | 69.1 | 69.1 |
| N300 Pale Oil | 14.4 | 14.1 | 14.1 |
| ORONITE ® 2939 | 14.75 | 14.5 | 14.5 |
| TLA-388 | 0.3 | 0.3 | 0.3 |
| Additive | — | 2.0 | 2.0 |
| UPOT Test Results | | | |
| Weight Loss (milligrams) | 216.5 | — | 167.1 |
| Viscosity Increase (%, at 100° F.) | 24.4 | 27.0 | 19.0 |

The test results clearly demonstrate lower viscosity increase and weight loss values for the lubricant composition containing the additive mixture of this invention, indicating increased oxidation and corrosion resistance properties provided by the additive even as compared to the corresponding composition containing ester additive only.

We claim:

1. A lubricant additive comprising a mixture of: (1) polyoxyalkylene ester having a structure:

$$RC\overset{O}{\overset{\|}{O}}(\overset{CH_2CH_3}{\overset{|}{C}}HCH_2O)_a(\overset{CH_3}{\overset{|}{C}}HCH_2O)_b(CH_2CH_2O)_c$$

$$(\overset{CH_3}{\overset{|}{C}}HCH_2O)_d(\overset{CH_2CH_3}{\overset{|}{C}}HCH_2O)_e(-\overset{O}{\overset{\|}{C}}R')_n(-H)_{1-n}$$

wherein:

R and R′ are independently unsaturated hydrocarbyl having at least about 10 carbon atoms;

the sum of a+e is an average of from 0 to about 12;

the sum of b+d is an average of from about 5 to about 150;

c is an average of from about 5 to about 150; and n is 0 or 1; and (2) aminopolyazole.

2. The additive of claim 1 wherein: n is 1, R and R′ are alkenyl having from about 12 to about 25 carbon atoms, and the aminopolyazole is aminotriazole or aminotetrazole.

3. The additive of claim 2 wherein: R and R′ are 9-octadecenoyl, a+c average about 2.5, b+d average about 28, c averages about 40, and the aminopolyazole is 3-amino-1,2,4triazole.

4. A lubricant composition comprising lubricant and an effective amount, which increases the oxidation and corrosion resistance of the lubricant, of the additive of claim 1.

5. The composition of claim 4 containing from about 0.1 to about 50 weight percent polyoxyalkylene ester and from about 0.001 to about 0.2 weight percent aminopolyazole.

6. The composition of claim 4 wherein: n is 1, R and R′ are alkenyl having from about 12 to about 25 carbon atoms, and the aminopolyazole is aminotriazole or aminotetrazole.

7. The composition of claim 6 wherein: R and R′ are 9-octadecenoyl, a+c average about 2.5, b+d average about 28, c average about 40, and the polyazole is amino-1,2,4-triazole.

8. A process for increasing the oxidation and corrosion resistance of a lubricant composition characterized by adding the lubricant an effective amount of an additive comprising a mixture of:

(1) polyoxyalkylene ester having a structure:

$$RC\overset{O}{\overset{\|}{O}}(\overset{CH_2CH_3}{\overset{|}{C}}HCH_2O)_a(\overset{CH_3}{\overset{|}{C}}HCH_2O)_b(CH_2CH_2O)_c$$

$$(\overset{CH_3}{\overset{|}{C}}HCH_2O)_d(\overset{CH_2CH_3}{\overset{|}{C}}HCH_2O)_e(-\overset{O}{\overset{\|}{C}}R')_n(-H)_{1-n}$$

wherein:

R and R′ are independently unsaturated hydrocarbyl having at least about 10 carbon atoms;

the sum of a+e is an average of from 0 to about 12;

the sum of b+d is an average of from about 5 to about 150;

c is an average of from about 5 to about 150; and n is 0 or 1; and (2) aminopolyazole.

9. The process of claim 8 wherein: n is 1, R and R′ are alkenyl having from about 12 to about 25 carbon atoms, and the aminopolyazole is aminotriazole or aminotetrazole.

10. The process of claim 9 wherein: R and R′ are 9-octadecenoyl, a+c average about 2.5, b+d average about 28, c averages about 40, and the aminopolyazole is 3-amino-1,2,4triazole.

11. The process of claim 8 wherein the composition comprises lubricant and from about 0.1 to about 50 weight percent polyoxyalkylene ester and from about 0.001 to about 0.2 weight percent aminopolyazole.

* * * * *